US008298094B1

(12) United States Patent
Chen

(10) Patent No.: US 8,298,094 B1
(45) Date of Patent: Oct. 30, 2012

(54) GOLF TRAINING APPARATUS FOR TRAINING SHORT GAME AND PUTTING GAME TECHNIQUES

(76) Inventor: Yung-Shen Chen, Taipei (TW)

( * ) Notice: Subject to any disclaimer, the term of this patent is extended or adjusted under 35 U.S.C. 154(b) by 0 days.

(21) Appl. No.: 13/219,722

(22) Filed: Aug. 29, 2011

(51) Int. Cl.
*A63B 69/36* (2006.01)

(52) U.S. Cl. ..... 473/261; 473/229; 473/258

(58) Field of Classification Search ..... 473/219, 473/221, 222, 229, 225, 257, 258, 259, 261
See application file for complete search history.

(56) References Cited

U.S. PATENT DOCUMENTS 3,953,035 A * 4/1976 Beckisk ..... 473/229
5,026,066 A 6/1991 Kane
5,467,993 A 11/1995 Higginson
5,658,204 A 8/1997 Nappi
5,895,327 A 4/1999 Francisco
6,364,786 B1 4/2002 Khano
6,461,246 B1 * 10/2002 Lee et al. ..... 473/151
6,551,197 B1 * 4/2003 Travo ..... 473/258
6,837,802 B1 * 1/2005 Santamaria ..... 473/258
7,883,429 B1 2/2011 Chen

* cited by examiner

*Primary Examiner* — Nini Legesse
(74) *Attorney, Agent, or Firm* — Pai Patent & Trademark Law Firm; Chao-Chang David Pai

(57) ABSTRACT

A golf training apparatus for training short game and putting game techniques includes (1) an upright support having an upright post, (2) a sliding track assembly having a first track bar transversely mounted at the upright post, a second track bar movably coupled to the first track bar and ball bearings set between the first track bar and the second track bar for guiding sliding movement of the second track bar along the first track bar, and (3) a golf club lock having a locking unit for locking a golf club and a universal joint connected to the locking unit and joined to the second track bar of the sliding track assembly for enabling the golf club to be swung with the universal joint and moved with the second track bar relative to the first track bar by a user.

6 Claims, 8 Drawing Sheets

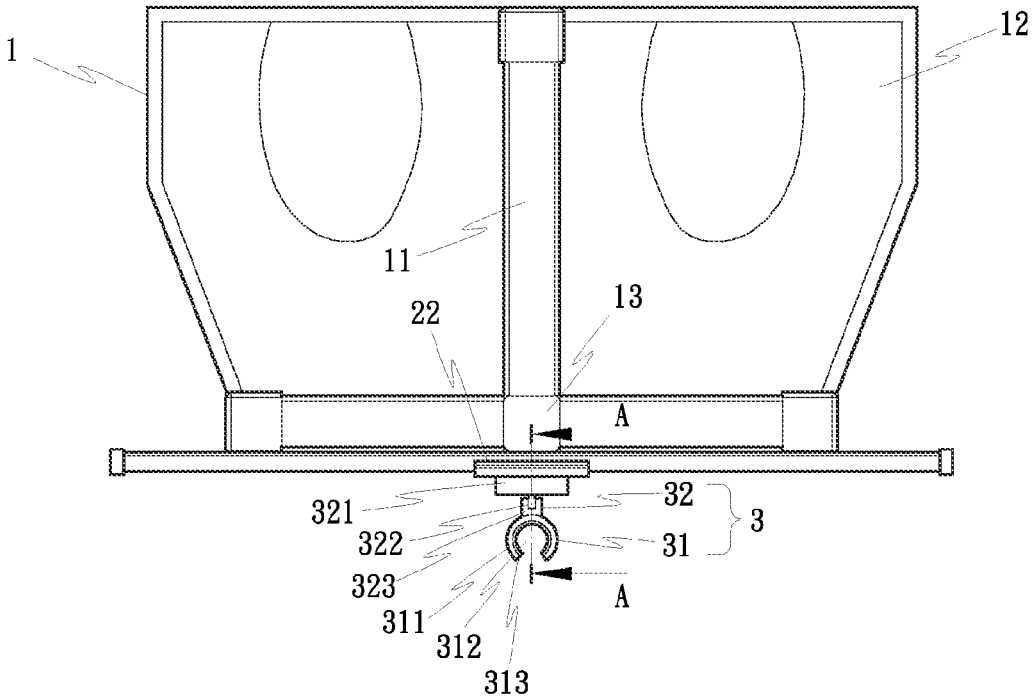
FIG. 3
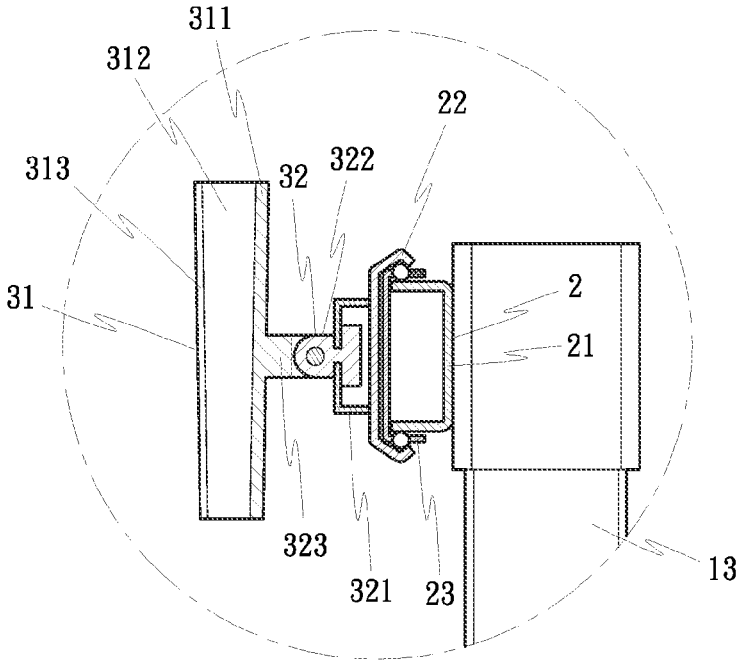
FIG. 4 A-A

GOLF TRAINING APPARATUS FOR TRAINING SHORT GAME AND PUTTING GAME TECHNIQUES

BACKGROUND OF THE INVENTION (a) Field of the Invention

The present invention relates to golf training technology and more particularly to a golf training apparatus for a golf player to quickly and accurately train short game and putting game techniques.

(b) Description of the Prior Art

In playing golf, it is important for a player, particularly a beginner, to learn how to accurately swing the golf club or putter. A player must constantly practice swinging and putting simulations in order to learn how to accurately perform putting game and short game techniques. Once well trained on the techniques, one can control the moving direction and the distance of the ball. A player may simulate swinging or putting actions on a putting green, divot, etc. However, every simulation action or posture is different. When practicing in this manner, one cannot learn accurate swinging game or putting game techniques within a short period. Any practicing error cannot be effectively corrected on the spot. Thus, a learner may be unaware of mistakes and will learn from experience only after a long period of practices.

Many golf training devices have been disclosed. However, those prior art designs are still not satisfactory in function. For example, U.S. Pat. No. 5,026,066 discloses a golf training apparatus, entitled "Practice Putting Guide", for use in improving a golfer's stroke during putting practices. The guide has a forwardly facing flat surface and a pair of rearwards extending mutually spaced leg engaging members suitably contoured to be held between a golfer's legs. U.S. Pat. No. 5,467,993 discloses another design of golf training apparatus, which has a complicated structure; U.S. Pat. No. 5,658,204 discloses a golf training apparatus, entitled "Putting Training Device Having Adjustable Stroke", which does not provide a track; U.S. Pat. No. 5,895,327 discloses a golf training apparatus, entitled "Golf Swing Aid and Method", which does not allow the use of a real golf club; U.S. Pat. No. 6,364,786 discloses a golf training apparatus, entitled "Golf Swing Teaching Device", which has a large size; U.S. Pat. No. 6,551,197 discloses a golf training apparatus, entitled "Golf Putting Practice Device", which is not freely rotatable to any desired direction and does not allow for practicing short game techniques; U.S. Pat. No. 7,883,429, issued to the present inventor, discloses a golf training apparatus, entitled "Golf Putting and Short-Swing Training Device", which is somehow complicated and does not allow adjustment of short swinging amplitude.

SUMMARY OF THE INVENTION

The present invention has been accomplished under the circumstances in view. It is one object of the present invention to provide a golf training apparatus which enables a player, particularly a beginner, to learn accurate putting game and short game techniques within a short period by utilizing a sliding track assembly supported on an upright support and a golf club lock with a universal joint provided at the sliding track assembly.

It is another object of the present invention to provide a golf training apparatus which has a simple structure and is inexpensive and easy to fabricate and easy to assemble.

To achieve these and other objects, the golf training apparatus according to the present invention comprises (1) an upright support having an upright post, (2) a sliding track assembly having a first track bar transversely mounted at the upright post, a second track bar movably coupled to the first track bar and ball bearings set between the first track bar and the second track bar for guiding sliding movement of the second track bar along the first track bar, and (3) a golf club lock having a locking unit for locking a golf club and a universal joint connected to the locking unit and joined to the second track bar of the sliding track assembly for enabling the golf club to be swung with the universal joint and moved with the second track bar relative to the first track bar by a user.

Further, the golf club lock comprises a socket. The socket comprises an axial taper hole fitting the shaft of a golf club, and a longitudinal slot cut through the socket wall thereof. Further, the universal joint has one end thereof connected to the wall of the socket.

Further, the universal joint comprises a base member connected to the second track bar, a first movable member rotatably mounted at the base member, and a second movable member pivotally coupled to the first movable member. The second movable member has one end thereof connected to the locking unit.

Further, the upright support further comprises a base frame supporting the upright post, and a foot plate fastened to the base frame.

The golf training apparatus further comprises a shield having one side thereof defining a groove and an opposite side thereof fastened to one side of the upright post of the upright support. Further, the first track bar of the sliding track assembly is mounted in the groove inside the shield.

The golf training apparatus of the present invention allows a user to install a real golf club or putter in the axial taper hole of the socket of the golf club lock for practicing putting game or short game techniques. By practicing repeatedly, the user can soon become familiar with the standard skills of putting or short swinging. When practicing, the golf club (putter) can be moved linearly back and forth along the sliding track assembly. Further, the user can adjust the angle to swing the golf club (putter) subject to the constraint of the universal joint. Thus, a player can repeatedly practice putting and short swinging. Further, because the sliding track assembly and the golf club lock both have a compact, simple structure, the golf training apparatus of the present invention has the advantage of low manufacturing cost.

BRIEF DESCRIPTION OF THE DRAWINGS

FIG. 3 is a top view of the golf training apparatus in accordance with the present invention.

FIG. 4 is a sectional view taken along line A-A of FIG. 3.

DETAILED DESCRIPTION OF THE PREFERRED EMBODIMENTS

Figure 1:
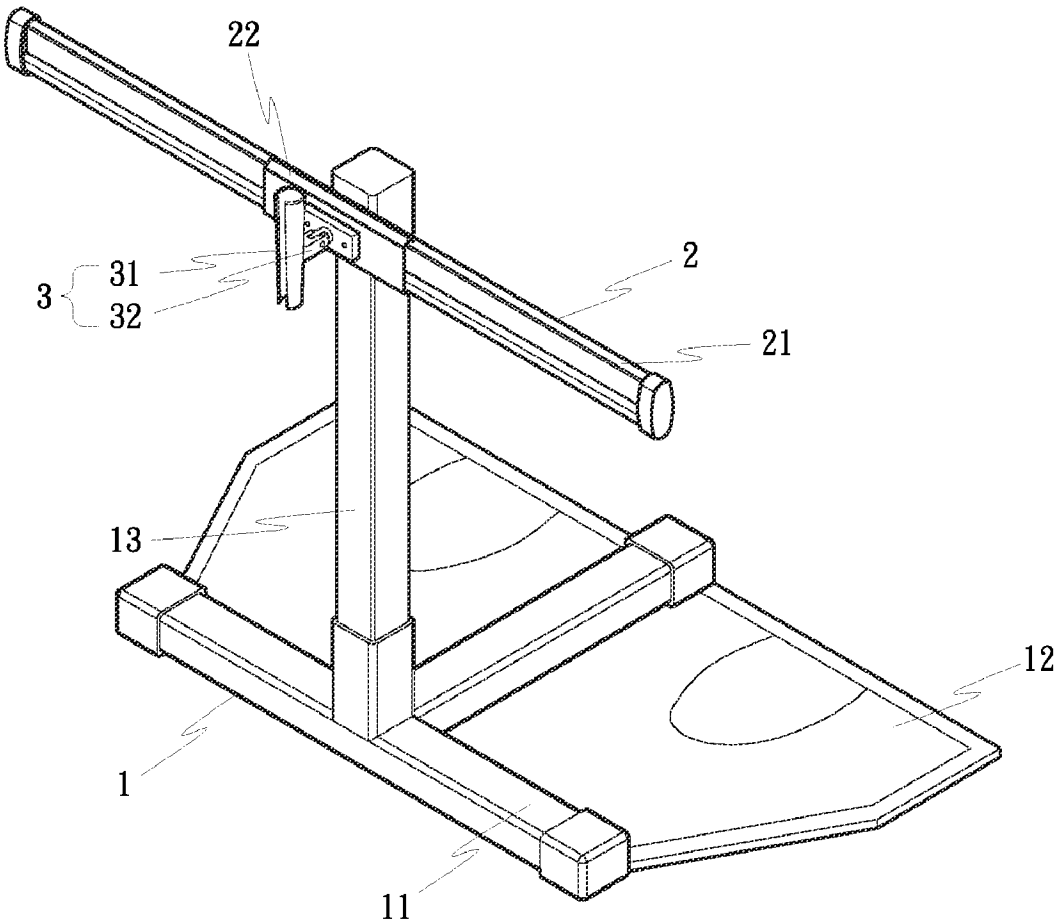
FIG. 1 is a perspective view of a golf training apparatus in accordance with the present invention.
Figure 2:
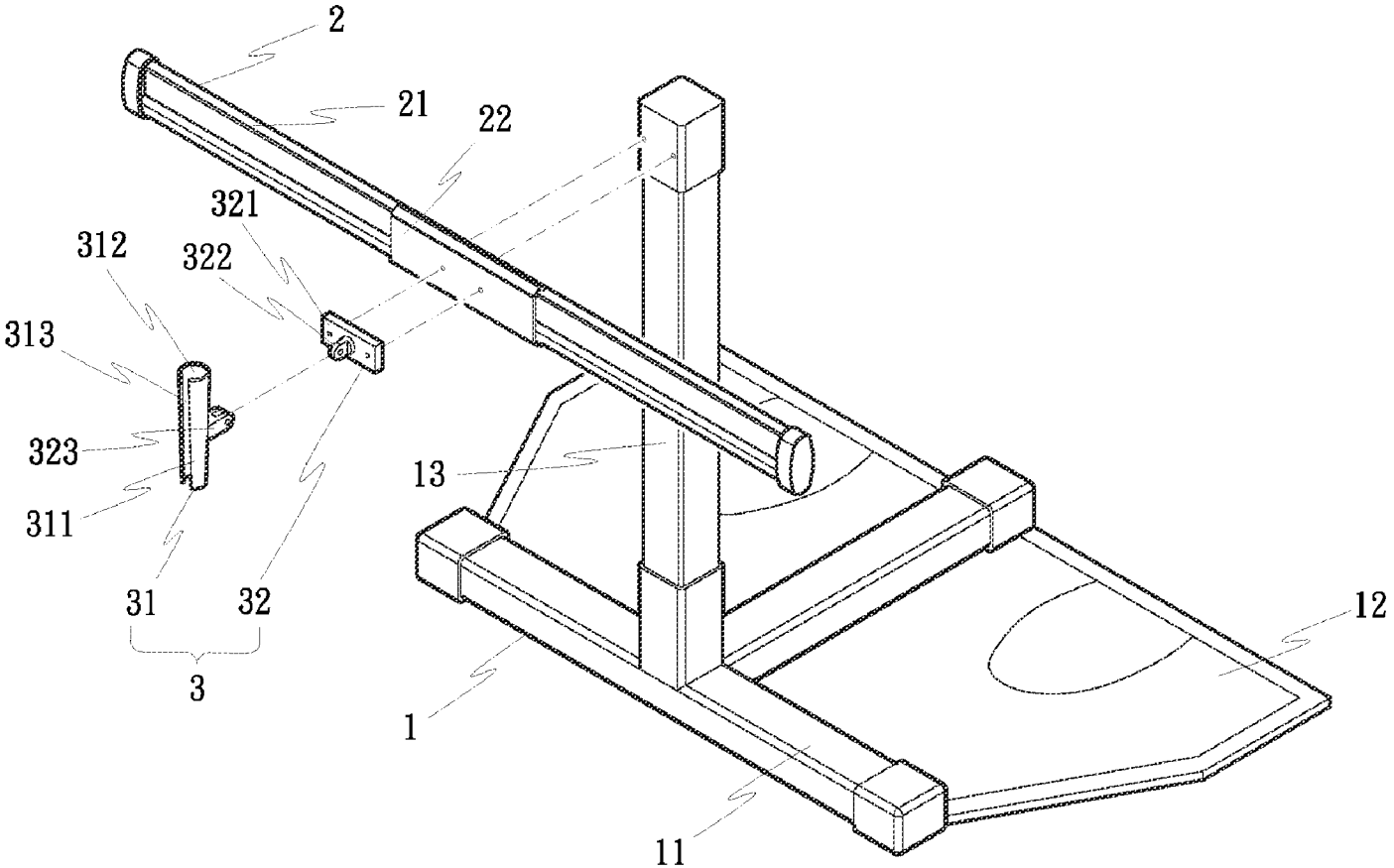
FIG. 2 is an exploded view of the golf training apparatus in accordance with the present invention.

Shown in FIGS. 1-3 is a golf training apparatus in accordance with the present invention for use by a player, particularly a beginner, to quickly and accurately train short game and putting game techniques. The golf training apparatus comprises an upright support 1, a sliding track assembly 2, and a golf club lock 3.

The upright support 1 comprises a base frame 11 for positioning on the floor or ground, a foot plate 12 affixed to the base frame 11, and an upright post 13 mounted at the top side of the base frame 11 and adjustable to the desired height within a limited range.

The sliding track assembly 2 comprises a first track bar 21 transversely mounted at one side of the upright post 13 and having a substantially U-shaped cross section, a second track bar 22 coupled to and movable along the length of the first track bar 21, and ball bearings 23 (see FIG. 4) set between the first track bar 21 and the second track bar 22 for guiding the sliding movement of the second track bar 22 along the first track bar 21.

Figure 9:
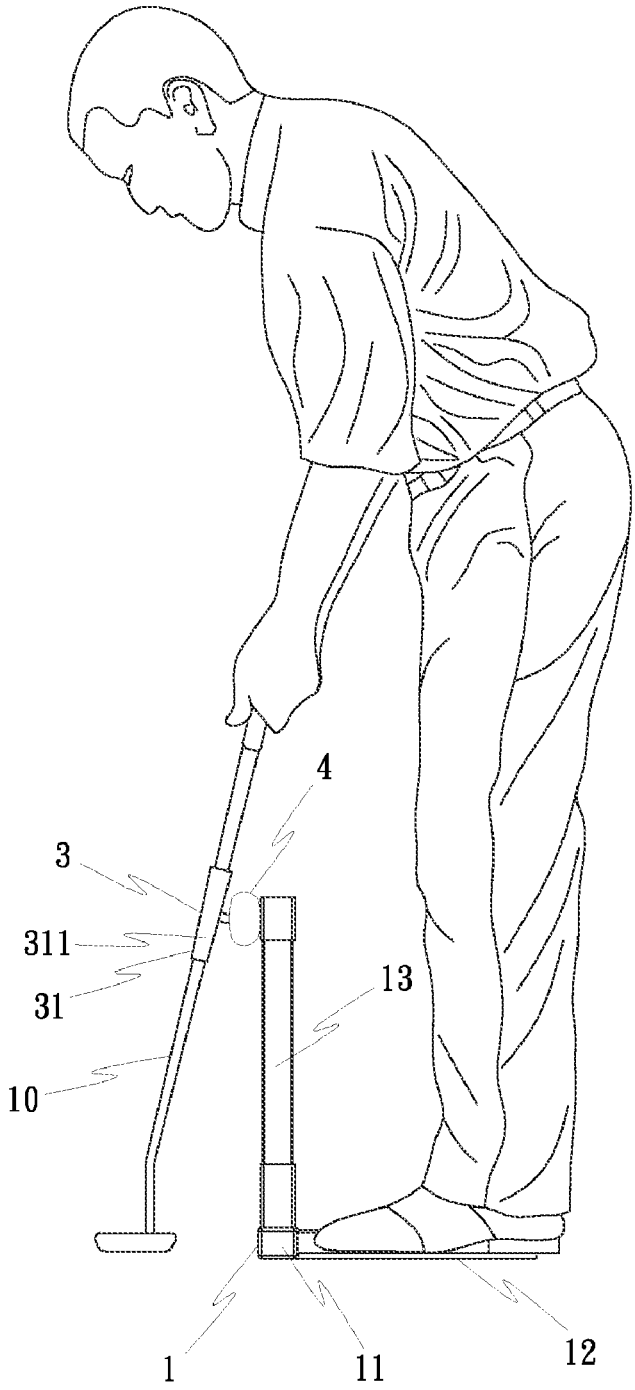
FIG. 9 is a schematic drawing illustrating an application of the golf training apparatus in accordance with the present invention.
Figure 10:
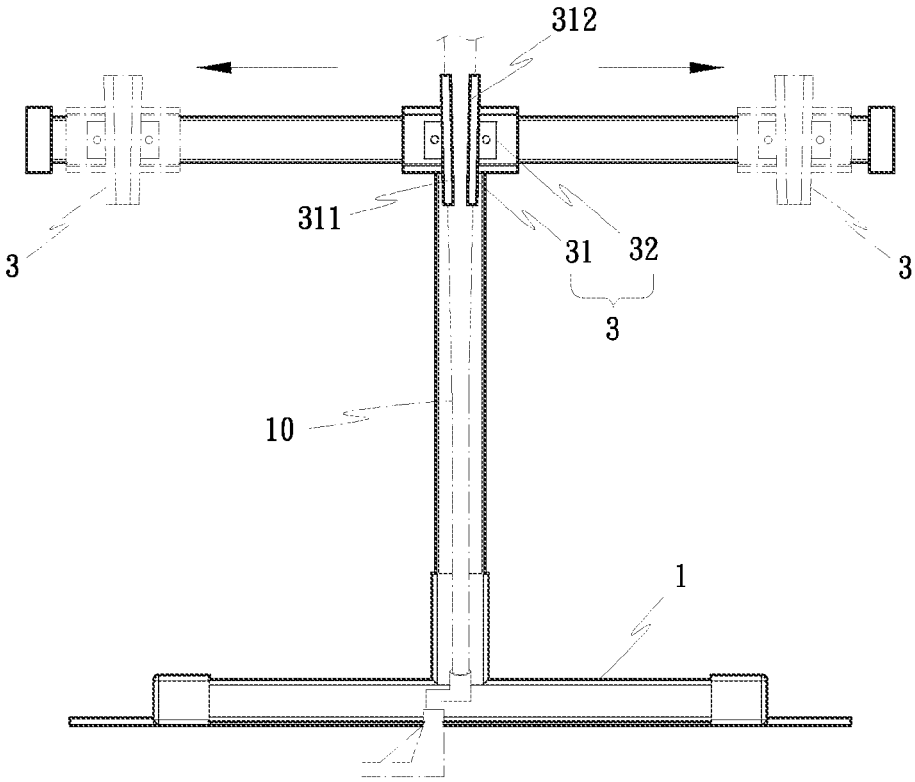
FIG. 10 is a schematic drawing of the present invention, illustrating the various operating possibilities of the sliding track assembly.
Figure 11:
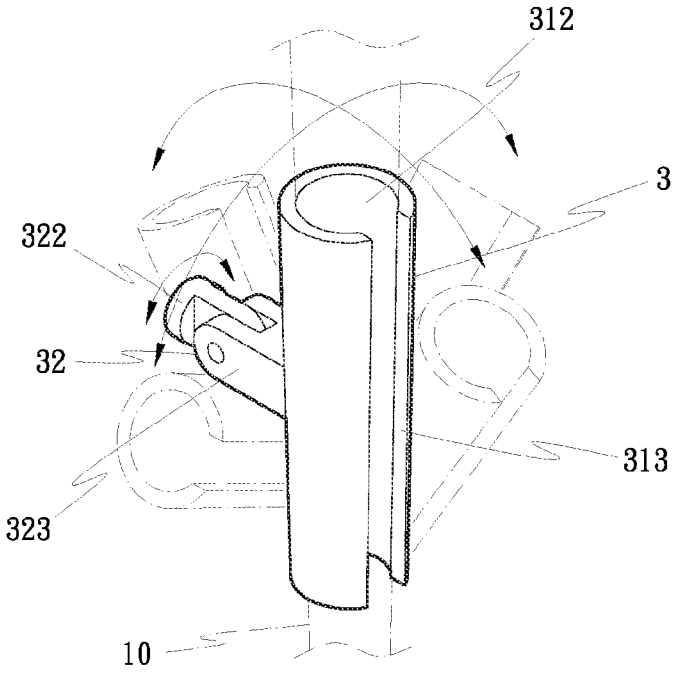
FIG. 11 is a schematic drawing of the present invention, illustrating the various operating possibilities of the golf club lock.

The golf club lock 3 comprises a locking unit 31 and a universal joint 32 connected to the locking unit 31. The locking unit 31 is adapted for locking a golf club. The universal joint 32 is joined to the second track bar 22 of the sliding track assembly 2. The upright support 1, the sliding track assembly 2 and the golf club lock 3 are assembled to form a golf training apparatus for training short game and putting game techniques. As shown in FIG. 9, a player can install a golf club (putter) 10 in the locking unit 31 of the golf club lock 3. When the player holds the golf club (putter) 10 to practice swinging techniques, as shown in FIGS. 10 and 11, the golf club (putter) 10 can be swung with the universal joint 32 and can also be moved linearly forwards and backwards along the sliding track assembly 2. Thus, the player can practice putting game and short game techniques repeatedly.

Figure 6:
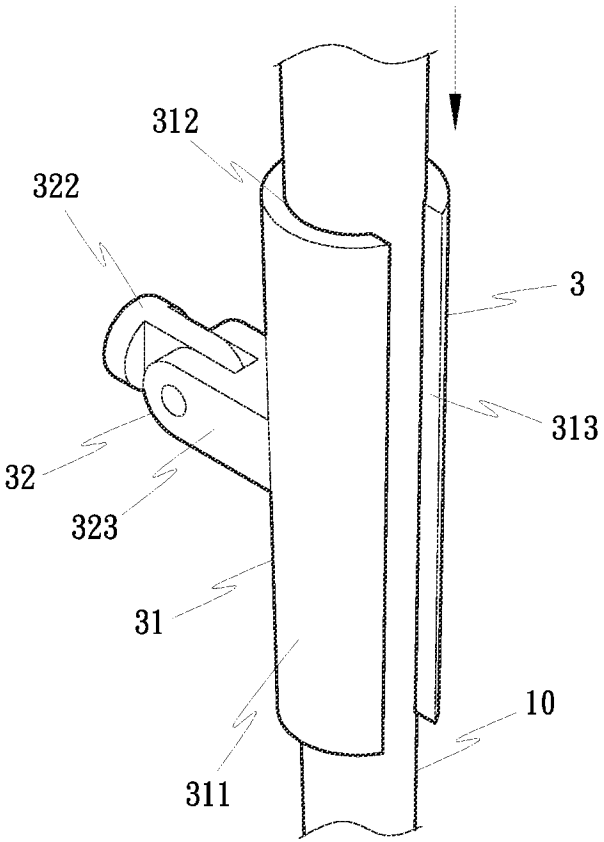
FIG. 6 is a schematic drawing illustrating the second step of the installation of a golf club in the golf training apparatus in accordance with the present invention.
Figure 5:
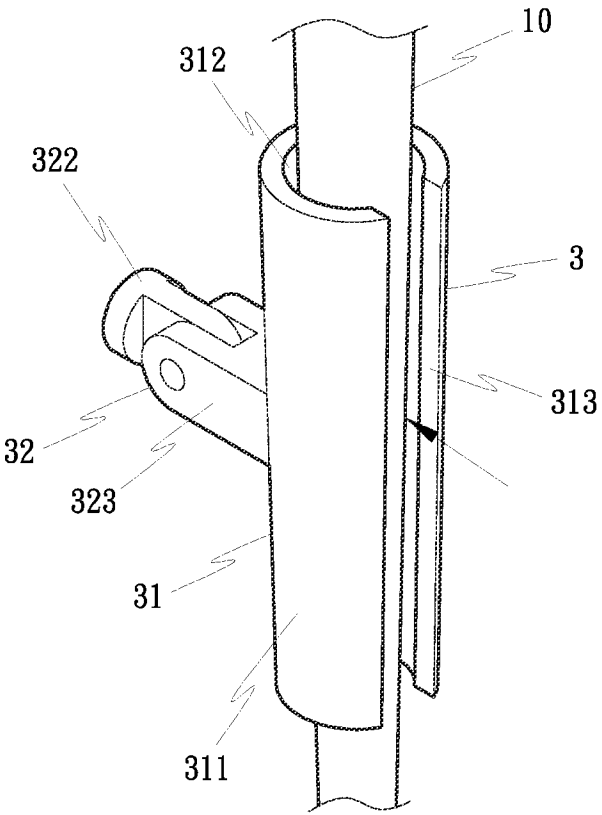
FIG. 5 is a schematic drawing illustrating the first step of the installation of a golf club in the golf training apparatus in accordance with the present invention.

Referring to FIGS. 2, 3 and 4, the locking unit 31 of the golf club lock 3 preferably comprises a socket 311, which comprises an axial taper hole 312 that fits the shaft of a golf club (putter) and a longitudinal slot 313 cut through the wall thereof. Further, one end of the universal joint 32 is connected to the wall of the socket 311. Thus, as shown in FIGS. 5 and 6, the player can transversely insert the thinner end of the shaft of the golf club (putter) 10 through the longitudinal slot 313 into the axial taper hole 312 and then axially lower the shaft of the golf club (putter) 10 to force the shaft of the golf club (putter) 10 into tight engagement with the axial taper hole 312. Thus, the golf club (putter) 10 is locked to the locking unit 31 of the golf club lock 3 and kept in accurate axial alignment with the socket 311.

Referring to FIGS. 2 and 4, the universal joint 32 of the golf club lock 3 preferably comprises a base member 321, a first movable member 322 rotatably mounted at the base member 321, and a second movable member 323 pivotally coupled to the first movable member 322. The base member 321 is connected to the second track bar 22. The second movable member 323 has its one end connected to the locking unit 31.

Figure 7:
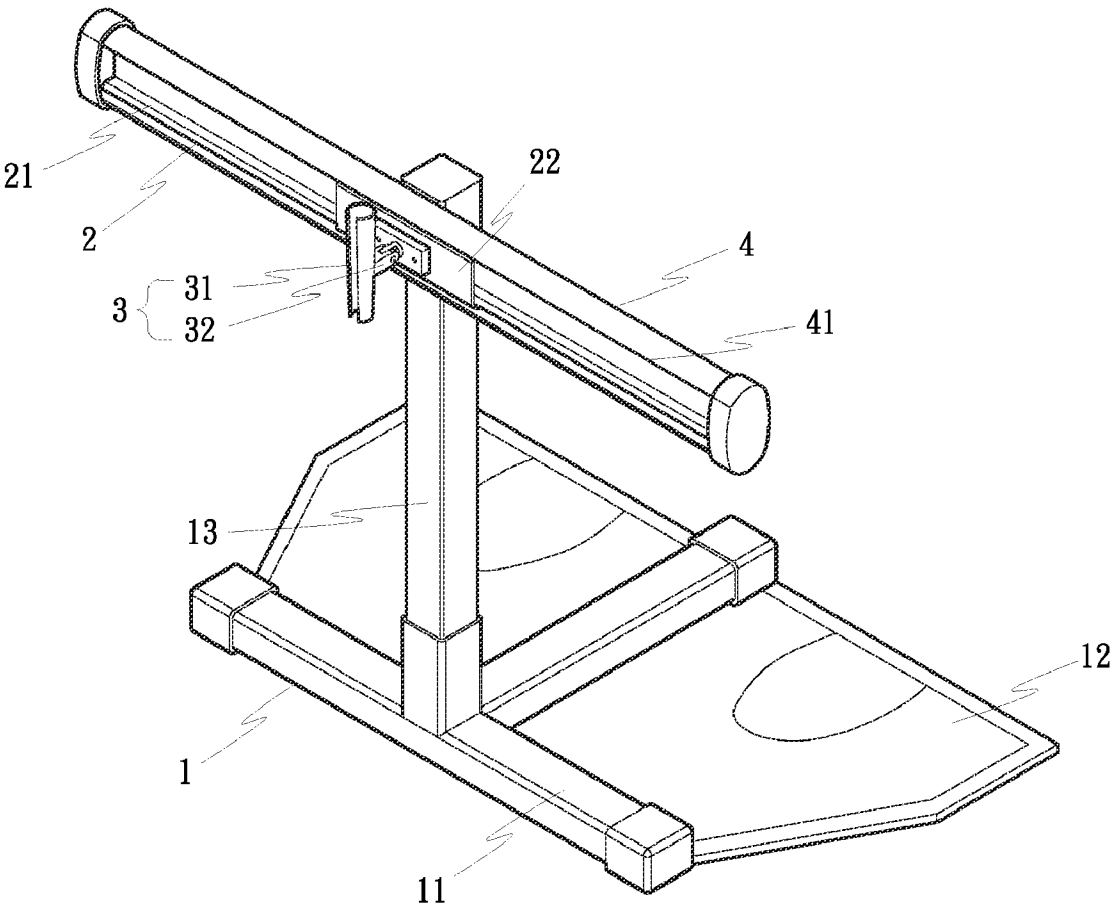
FIG. 7 illustrates a shield used in the golf training apparatus in accordance with the present invention.
Figure 8:
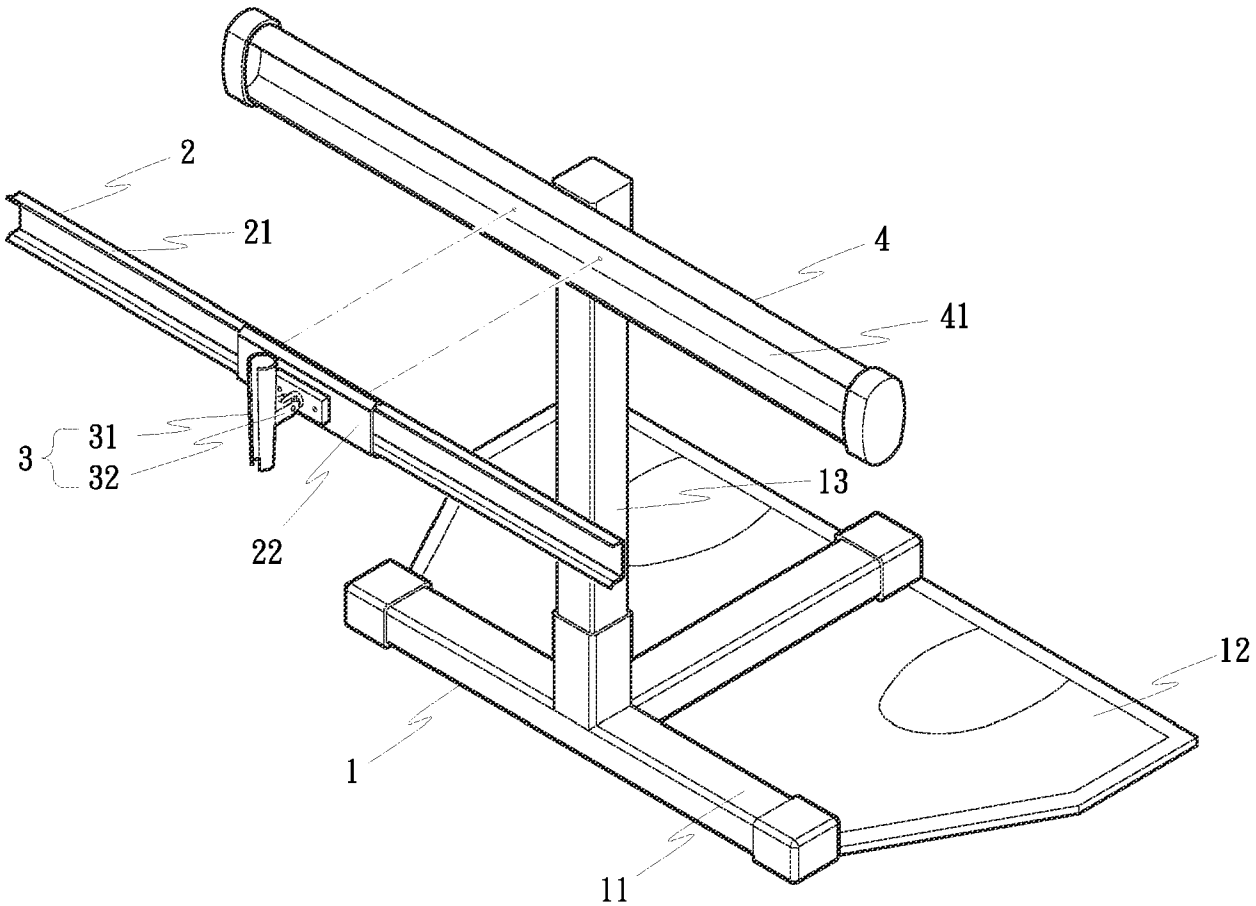
FIG. 8 is an exploded view of FIG. 7.

As shown in FIGS. 7 and 8, the golf training apparatus in accordance with the invention further comprises a shield 4. The shield 4 has one side thereof defining a groove 41 and the other side thereof fastened to one side of the upright post 13 of the upright support 1. The first track bar 21 of the sliding track assembly 2 is mounted in the groove 41 inside the shield 4. Thus, the sliding track assembly 2 is concealed in the shield 4, enhancing the appearance of the golf training apparatus.

Referring to FIG. 9, the golf training apparatus of the present invention enables a player, particularly a beginner, to practice putting game or short game techniques. The player simply installs the golf club (putter) 10 in the socket 311 of the locking unit 31 of the golf club lock 3 according to the aforesaid installation procedure. After the golf club (putter) 10 is installed, the player stands on the foot plate 12 of the upright support 1 in the marked position, and then holds the golf club (putter) 10 to perform a short swinging or putting action while adjusting the posture, action and angle during the practice. By practicing repeatedly, the player can soon become familiar with the standard skills of putting or short swinging. When practicing, as shown in FIG. 10, the golf club (putter) 10 can be moved linearly back and forth along the sliding track assembly 2. Further, as shown in FIG. 11, the user can adjust the angle to swing the golf club (putter) 10 subject to the constraint of the universal joint 32. Thus, a player can repeatedly practice putting and short swinging. Further, because the sliding track assembly 2 and the golf club lock 3 both have a compact, simple structure, the golf training apparatus in accordance with the present invention can be manufactured at a low cost.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A golf training apparatus for training short game and putting game techniques, comprising:

an upright support comprising an upright post;

a sliding track assembly comprising a first track bar transversely mounted at one side of a top end of said upright post, a second track bar movably coupled to said first track bar, and ball bearings set between said first track bar and said second track bar for guiding sliding movement of said second track bar along said first track bar; and a golf club lock comprising a locking unit and a universal joint connected to said locking unit, said locking unit being adapted for locking a golf club at the shaft of the golf club so that the head of the golf club is positioned below said second track bar, said universal joint being joined to a lateral wall of said second track bar of said sliding track assembly for enabling the golf club at said locking unit to be swung with said universal joint and moved with said second track bar relative to said first track bar.

2. The golf training apparatus as claimed in claim 1, wherein said golf club lock comprises a socket, said socket comprising an axial taper hole for receiving the shaft of a golf club and a longitudinal slot cut through a wall thereof; and said universal joint is connected to said locking unit by having one end thereof connected to said wall of said socket.

3. The golf training apparatus as claimed in claim 2, wherein said universal joint comprises a base member connected to said second track bar, a first movable member rotatably mounted at said base member, and a second movable member pivotally coupled to said first movable member; and said universal joint is connected to said locking unit via one end of said second movable member.

4. The golf training apparatus as claimed in claim 1, wherein said upright support further comprises a base frame supporting said upright post, and a foot plate fastened to said base frame.

5. The golf training apparatus as claimed in claim 1, further comprising a shield having one side thereof defining a groove and an opposite side thereof fastened to one side of said upright post of said upright support, wherein said first track bar of said sliding track assembly is mounted in said groove inside said shield.

6. The golf training apparatus as claimed in claim 1, wherein said lateral wall of said second track bar of said sliding track assembly is substantially vertical to the ground.

* * * * *